US011774221B1

(12) United States Patent
Peterson et al.

(10) Patent No.: US 11,774,221 B1
(45) **Date of Patent: *Oct. 3, 2023**

(54) HANDGUN CARTRIDGE

(71) Applicant: Federal Cartridge Company, Anoka, MN (US)

(72) Inventors: Bryan P. Peterson, Isanti, MN (US); Matthew S. Schroeder, Princeton, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/856,930

(22) Filed: Jul. 1, 2022

(51) Int. Cl.
*F42B 5/02* (2006.01)

(52) U.S. Cl.
CPC ..... *F42B 5/025* (2013.01)

(58) Field of Classification Search
CPC .. F42B 5/025; F42B 5/28; F42B 12/34; F42B 12/78
See application file for complete search history.

(56) References Cited

U.S. PATENT DOCUMENTS 7,822,263 B1 10/2010 Prokoski
8,196,328 B2 6/2012 Simpkins
8,430,035 B2 4/2013 Ducastle, Jr.
10,184,738 B1 1/2019 Kellgren
2011/0214583 A1 9/2011 Dutch

OTHER PUBLICATIONS

"The .327 Federal", B. Forker, Guns & Ammo, Feb. 2009, pp. 24 and 26.
"Load data for 8mm Roth Steyr?" Tapatalk, 2010.
DMK Catalog, 1891.
8 mmRoth-Steyr Cartridge, https://www.valka.cz/topic/view/19791/8-mm-Steyr.
DMK Catalog, 1882.
"The Small Miracle of the .327 Federal Magnum", S. Gash, https://gundigest.com/handguns/small-miracle-327-federal-magnum.
"Cartridges of the World", F. Barnes, 2019, pp. 422-434, 481-483, 615-616, 623-625.
"Shooter's Bible Guide To Cartridges", W. Todd Woodard, 2011, pp. 191-193.
BulletBlog—8mm Roth-Steyr Cartridge, 2014.
Bergmann No. 7 cartridges, https://forum.cartridgecollectors.org/t/bergmann-no-7-cartridges/26582, 2017.

*Primary Examiner* — Jonathan C Weber
(74) *Attorney, Agent, or Firm* — Reed Smith LLP; Matthew P. Frederick; Travis J. Sumpter

(57) ABSTRACT

Devices and methods for an 8 mm or .32 caliber semiautomatic handgun cartridge providing a reduced form factor for carrying a greater number of rounds in a smaller space while maintaining ballistic performance.

20 Claims, 9 Drawing Sheets

| TERMINAL BALLISTICS | 10% BARE GELATIN | 4-LAYER DENIM |
|---|---|---|
| | Upset | Upset |
| 100gr Gold Dot |  |  |
| 115gr Gold Dot |  |  |

HANDGUN CARTRIDGE

FIELD OF THE INVENTION

The present invention generally relates to cartridges for use with handguns. More particularly, the present invention is directed to cartridges suitable for use as semiautomatic handgun ammunition with an improved form factor with performance comparable to larger competing cartridges.

BACKGROUND OF THE INVENTION

Exemplary embodiments disclosed herein relate to cartridges for the personal defense market. A commonly used cartridge is the 9 mm Luger (also commonly designated 9×19 and 9 mm Parabellum). The 9 mm Luger is preferred by some over some larger cartridges e.g. the 40 Smith & Wesson (S&W) due to its lethality and acceptable recoil.

SUMMARY OF THE INVENTION

A cartridge for use in a semiautomatic handgun comprises a case and a bullet. The 8 mm or .32 caliber cartridge generates a pressure up to 50,000 psi.

A feature and benefit of embodiments is a semiautomatic .32 caliber cartridge, comprising a rimless case, a .32 caliber bullet, a propellant, and a primer, the cartridge having a length of from 1.100 in. to 1.169 in. The rimless case comprises a case length of about 0.827 in., a flange diameter of 0.3440 in., an outer case diameter that tapers from a flange diameter of 0.3440 in. to a case mouth diameter of 0.3370 in., an intermediate case portion comprising a length of 0.500 in., a rear end outer diameter of 0.3425 in., and a forward end outer diameter of 0.3381 in., and a rear end comprising a groove and flange. The .32 caliber bullet is seated in a case mouth at the forward end of the case, the bullet comprising a weight of about 60-120 gr. The propellant in the case is configured to provide a chamber pressure of about 32,000-55,000 psi. The primer is seated in the flange.

In embodiments, the muzzle velocity of the bullet fired from a pistol is about 1120-1350 fps.

In embodiments, wherein the muzzle energy of the bullet fired from a pistol is about 320-405 ft-lbf.

In embodiments, the case further comprises an internal thickness taper portion that decreases in thickness toward the forward end of the cartridge, the internal thickness taper portion extending for an axial length of about 0.150-0.350 in.

In embodiments, the primer further comprising dimensions selected from one of: a base thickness of at least 0.0205 in., a diameter of from 0.1745 in. to 0.1765 in., and a height of from 0.115 in. to 0.126 in., or a base thickness 60 of about 0.0190-0.0200 in., an outer diameter of about 0.1746-0.1752 in., and a height of about 0.1075-0.1165 in.

In embodiments, the bullet comprises a hollow point.

In embodiments, the case comprises a brass material.

In embodiments, the bullet comprises one or more of: a core comprising lead, a jacket comprising copper, and a length of about 0.4-0.9 in.

A feature and benefit of embodiments is a semiautomatic .32 caliber cartridge, comprising a rimless case, a .32 caliber bullet, a propellant, and a primer, the cartridge having a length of from 1.100 in. to 1.169 in. The rimless case comprises a case length of about 0.827 in., a flange diameter of 0.3440 in., an outer case diameter that tapers from a flange diameter of 0.3450 in. to a case mouth diameter of 0.3370 in., an intermediate case portion comprising a length of 0.500 in., a rear end outer diameter of 0.3425 in., and a forward end outer diameter of 0.3381 in., and a rear end comprising a groove and flange. The .32 caliber bullet is seated in the case mouth at the forward end of the case, the bullet comprising a weight of from about 60-120 gr. The propellant in the case is configured to provide a chamber pressure of about from 32,000 psi to 52,000 psi. The primer is seated in the flange.

In embodiments, the cartridge generates a pressure comprising 45,000-52,000 psi.

In embodiments, the muzzle velocity of the bullet fired from a pistol is about 1120-1350 fps.

In embodiments, the muzzle energy of the bullet fired from a pistol is about 320-405 ft-lbf.

In embodiments, the case further comprises an internal thickness taper portion that decreases in thickness toward the forward end of the cartridge, the internal thickness taper portion extending for an axial length of about 0.150-0.350 in.

In embodiments, the bullet comprises a core comprising lead and a jacket comprising copper.

In embodiments, the bullet comprises one or more of: a hollow point, and a length of from about 0.4-0.9 in.

In embodiments, the case comprises a brass material.

A feature and benefit of embodiments is a semiautomatic .32 caliber cartridge, comprising a rimless case, a .32 caliber bullet, a propellant, and a primer, the cartridge having a length of from 1.100 in. to 1.169 in. The rimless case comprises a case length of about 0.827 in., a flange diameter of 0.3440 in., an outer case diameter that tapers from a flange diameter of 0.3440 in. to a case mouth diameter of 0.3370 in., an intermediate case portion comprising a length of 0.500 in., a rear end outer diameter of 0.3425 in., and a forward end outer diameter of 0.3381 in., an internal thickness taper portion that decreases in thickness toward the forward end of the cartridge, and a rear end comprising a groove and flange. The .32 caliber bullet seated in a case mouth at the forward end of the case and positioned forward of the internal thickness taper portion, the bullet comprising a weight of about 60-120 gr, and length of from about 0.4 in. to 0.9 in. The propellant in the case is configured to provide a chamber pressure of about 32,000-55,000 psi. The primer is seated in the flange. The cartridge is configured such that the muzzle velocity of the bullet fired from a pistol is between about 1120-1350 fps, and the muzzle energy of the bullet fired from a pistol is about 320-405 ft-lbf.

In embodiments, the internal thickness taper portion extends for an axial length of about 0.150-0.350 in.

In embodiments, the primer further comprises dimensions selected from one of: a base thickness of at least 0.0205 in., a diameter of from 0.1745 in. to 0.1765 in., and a height of from 0.115 in. to 0.126 in., or a base thickness 60 of about 0.0190-0.0200 in., an outer diameter of about 0.1746-0.1752 in., and a height of about 0.1075-0.1165 in.

In embodiments, the bullet comprises one or more of: a hollow point, a core comprising lead, a jacket comprising copper, and a length of about 0.4-0.9 in.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
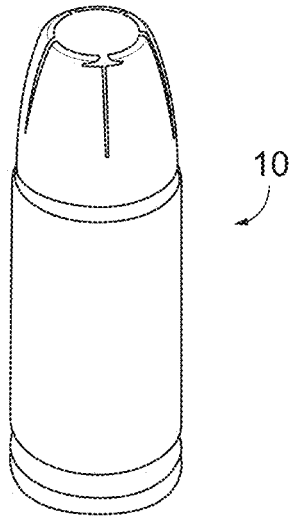
FIG. 1 PRIOR ART
FIG. 1 is a front perspective view of a prior art 9 mm cartridge.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 2:
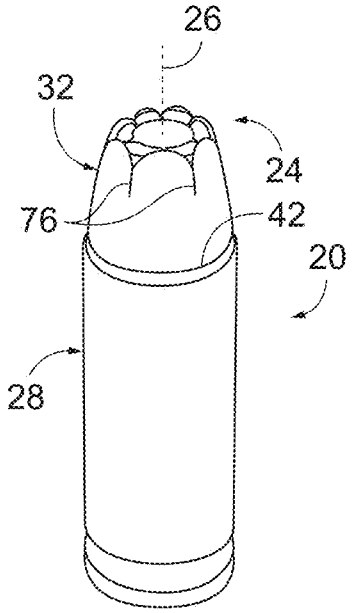
FIG. 2 is a perspective view of an 8 mm cartridge in accord with embodiments of the present disclosure.
Figure 3:
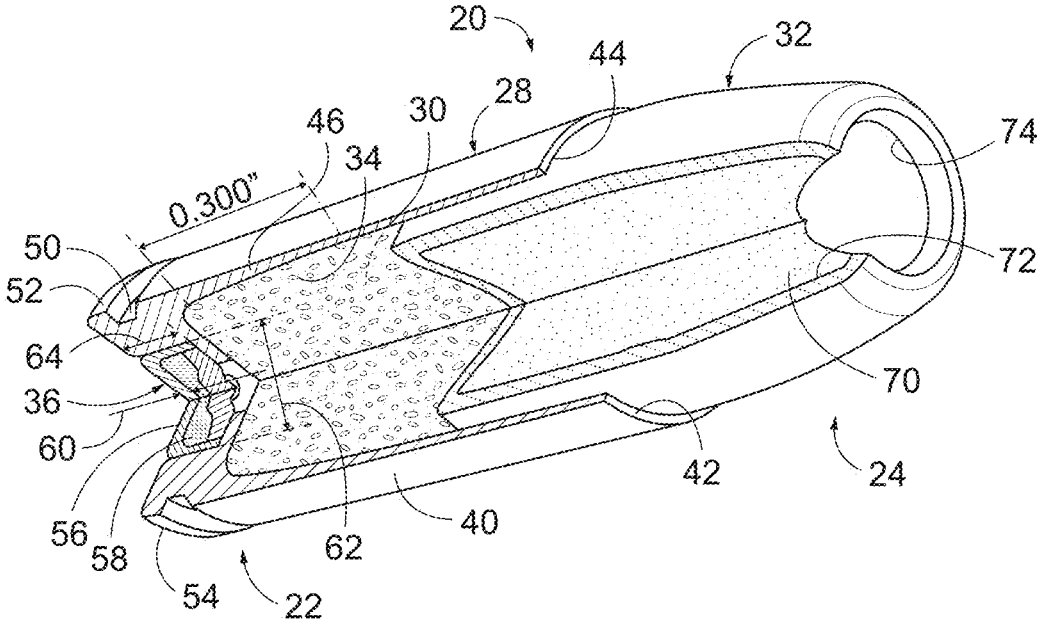
FIG. 3 is a sectioned perspective view of the 8 mm cartridge of FIG. 2
Figure 4:
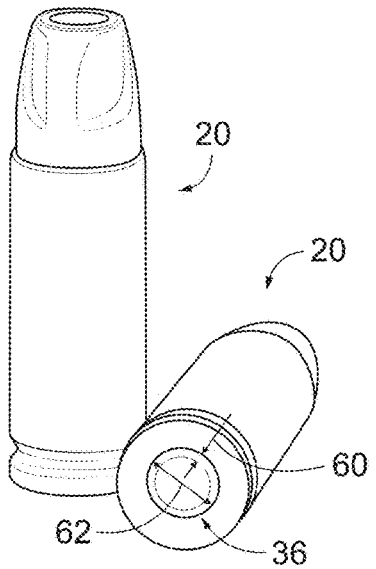
FIG. 4 is a front perspective view and a bottom perspective view of two 8 mm cartridges in accord with embodiments of the present disclosure.

FIG. 1 shows a prior art 9 mm Luger cartridge 10, which is in wide use and provides an overall cartridge length of 1.100-1.169 in. with a caliber of .355 in. FIGS. 2-4 show an embodiment of a cartridge 20 constructed in accordance with embodiments of the invention. The cartridge 20 is generally considered an 8 mm or .32 caliber, also referred to as a "30 Super Carry," a "Super Carry," a "30 Super," or an "8 mm" cartridge. In embodiments, the cartridge 20 has an overall cartridge length of 1.100-1.169 in. with a bullet diameter of 0.3130 in. or 8 mm. The cartridge 20 is a rimless high pressure semi-automatic pistol cartridge advantageously designed for concealed carry purposes. In comparison with the 9 mm Luger cartridge 10, the cartridge 20 of the present invention has a decreased projectile diameter from .35 cal (9 mm) to .32 cal (8 mm), which allows for more rounds be carried for a given magazine width and height, while at the same time reducing the magazine/grip width. The magazine/grip height may also be reduced, or it may be comparable in height while holding more 8 mm cartridges than it is possible to hold 9 mm cartridges. The cartridge 20 is fitted to firearms with a bore diameter of about 0.303 inches. Additional examples of applicable cartridge and chamber features are disclosed in the commonly-owned U.S. patent application Ser. No. 17/153,758, filed Jan. 20, 2021 and U.S. Provisional Patent Application No. 62/963,257 filed on Jan. 20, 2020, the disclosures of which are incorporated by reference herein in their entirety and for all purposes.

In certain embodiments, the pressure generated by the cartridge 20 is 50,000 psi, or about 50,000 psi. In other embodiments, the cartridge pressure is at least 32,000 psi; at least 45,000 psi; between 45,000-52,000 psi; or between 32,000-55,000 psi. By increasing pressure to a level above conventional small caliber rounds, the Super Carry cartridge 20 can approach the same energy levels as the 9 mm Luger for 100-115 grain (gr) projectiles, which in turn provides comparable ballistic performance.

In embodiments, the cartridge 20 is a rimless cartridge extending from a rear end 22 to a forward end 24 along a longitudinal axis 26. The cartridge 20 includes a case 28 having an interior cavity 30, which receives and holds a portion of a bullet 32. The case 28 may be formed of brass or other known materials and contains a propellant 34 and a primer 36 (FIG. 3).

Figure 5A:
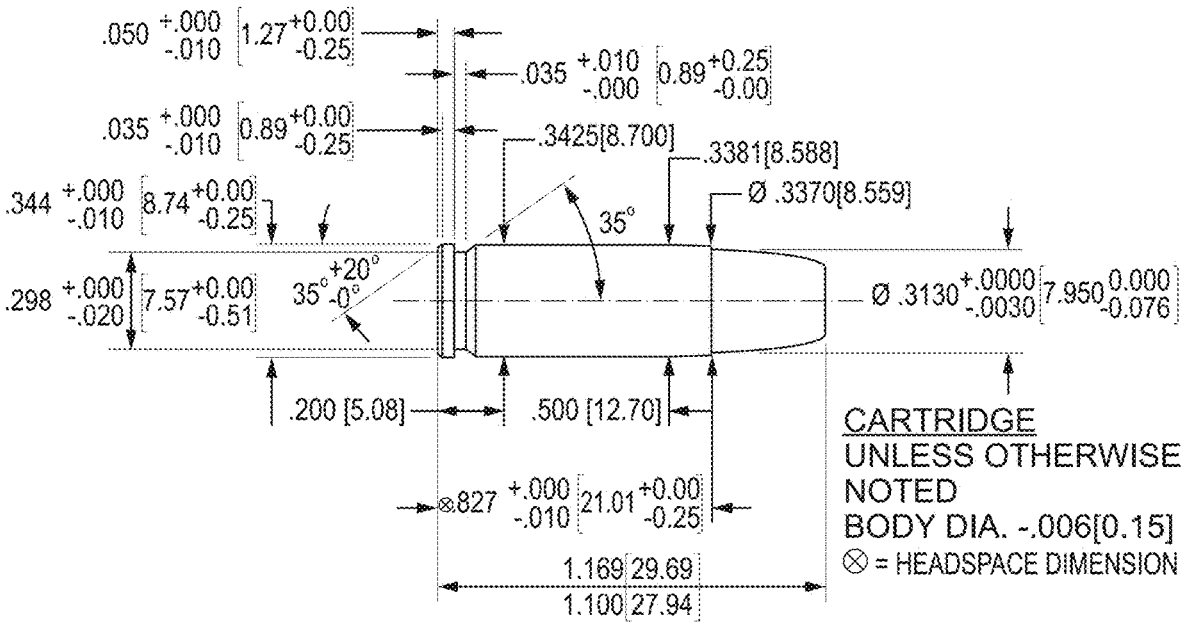
FIG. 5A is a schematic view of an embodiment of the 8 mm cartridge of FIG. 2 specifying dimensions.
Figure 5B:
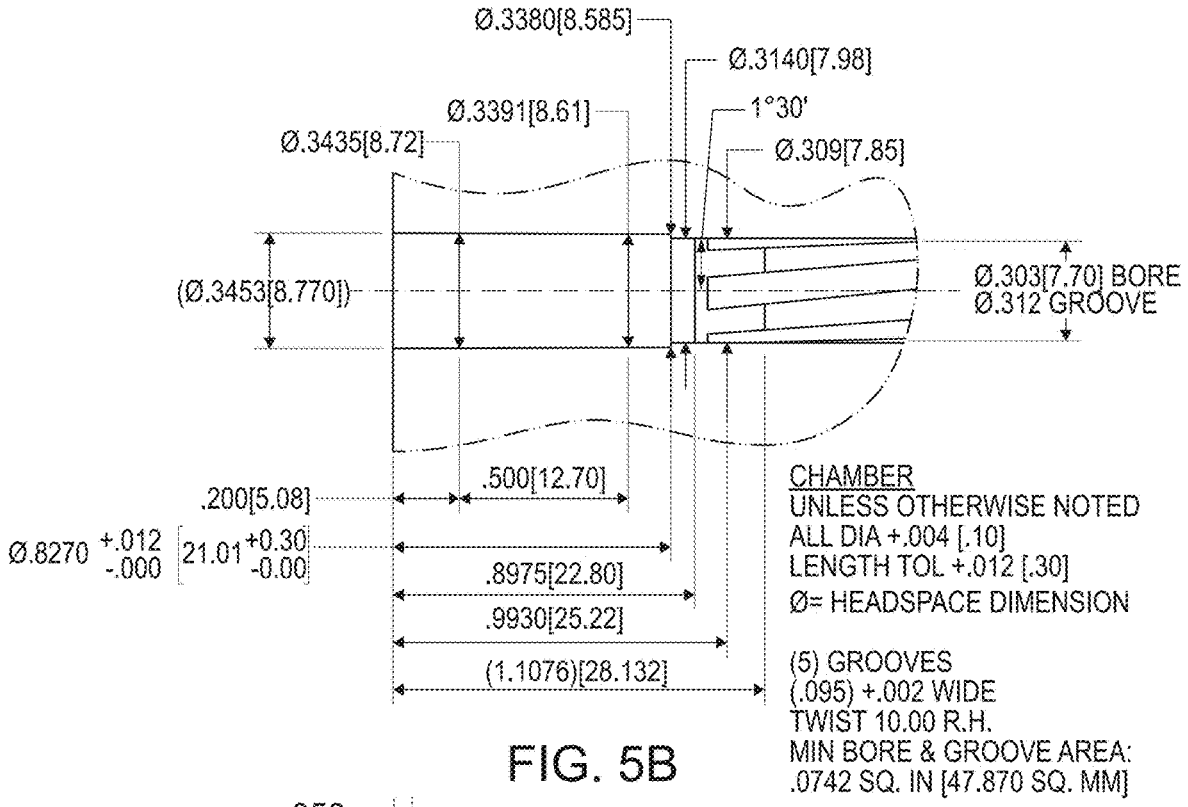
FIG. 5B is a schematic view of an embodiment of a chamber and barrel for use with the 8 mm cartridge of FIG. 5A and specifying dimensions.
Figure 6A:
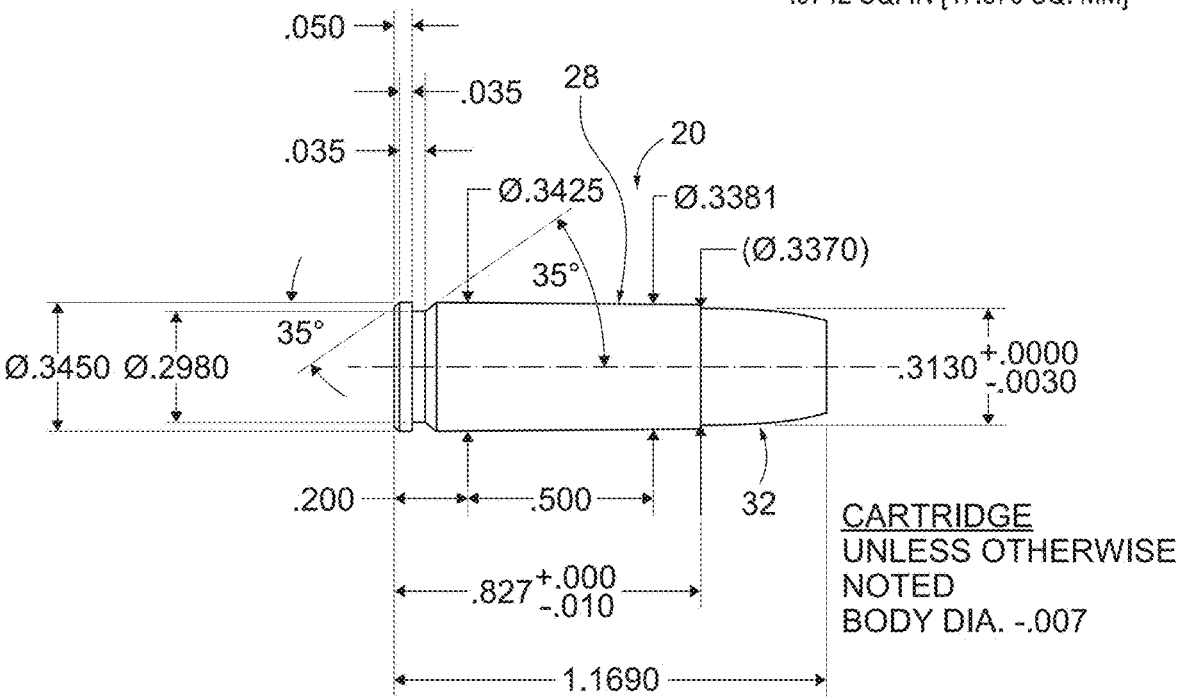
FIG. 6A is a schematic view of an embodiment of the 8 mm cartridge of FIG. 2 specifying dimensions.
Figure 6B:
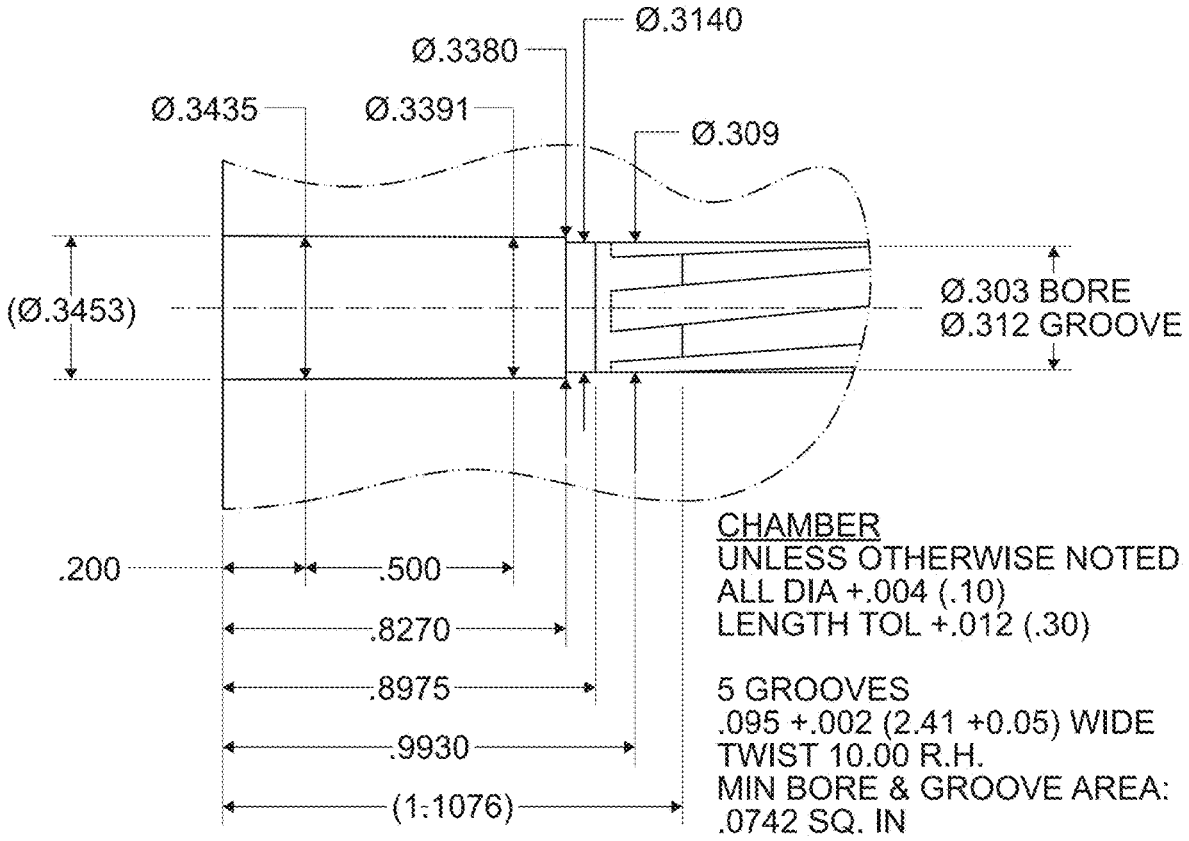
FIG. 6B is a schematic view of an embodiment of a chamber and barrel for use with the 8 mm cartridge of FIG. 6A and specifying dimensions.

In some embodiments, the case 28 may include a wall 40 with an outer diameter that tapers toward the forward end 24 to aid in feeding and extraction. In certain embodiments shown, for example, in FIG. 5A, the case 28 includes an outer case diameter that tapers from a flange diameter of 0.344 in. (or from a rear end outer diameter of 0.3425 in.) to a case mouth diameter of 0.3370 in. In certain other embodiments shown, for example, in FIG. 6A, the case 28 includes an outer case diameter that tapers from a flange diameter of 0.3450 in. (or from a rear end outer diameter of 0.3425 in.) to a case mouth diameter of 0.3370 in. In embodiments, the case 28 includes an intermediate case portion comprising a length of 0.500 in., the intermediate case portion including a rear end outer diameter of 0.3425 in., and a forward end outer diameter of 0.3381 in. The forward end 24 of the case 28 may include a leading edge 42 defining a case mouth 44. The case mouth 44 is configured to hold the bullet 32, for example via friction fit engagement, crimping, bonding, or the like. As shown in FIG. 3, the wall 40 of the case 28 defines a thickness that may include an internal thickness taper portion 46 that decreases in thickness toward the forward end 24 of the cartridge. The internal thickness taper portion 46 extends axially for a taper length 48 measured from the inside bottom of the case to the intersection of the taper portion 46 with a constant-thickness upper case wall. In various embodiments, the taper length 48 may be about 0.209-0.229 in., about 0.300 in., about 0.200-0.300 in., about 0.150-0.350 in., and less than about 0.300 in. In certain embodiments the taper length 48 extends only rearward of the bullet 32. Forward of the internal thickness taper portion 46, the case 28 has a constant thickness continuing to the leading edge 42.

In embodiments, at the rear end 22 of the cartridge 20, the case 28 comprises a groove 50 that provides an extraction surface for the spent cartridge 20 during cycling. A flange 52 encloses the groove and defines a bottom 54 or trailing edge of the case 28. The flange 52 houses the primer 36. The primer 36 includes a primer cup 56 containing a primer compound 58. The primer 36 may comprise a thicker primer cup 56, particularly base thickness 60, than standard semi-automatic pistol or revolver primers. In certain embodiments best shown in FIG. 3, the primer 36 has a base thickness 60 along with a diameter 62 of 0.1748-0.1751 in., and a height 64 of 0.110-0.116 in. The base thickness 60 may be about 0.0205-0.0225 in., about 0.0205-0.0250 in., about 0.0180-0.0250 in., or generally greater than about 0.018 in., greater than about 0.019 in., or greater than about 0.020 in. In other embodiments, the primer 36 has a base thickness 60 of about 0.0190-0.0200 in., an outer diameter of about 0.1746-0.1752 in., and a height of about 0.1075-0.1165 in.

Generally, embodiments of the primer 36 may be designed for conventional small-caliber rifles. The primer 36 according to certain embodiments burns hotter than conventional pistol primers. In certain embodiments, the primer compound 58 includes aluminum. In some embodiments, the primer is the Federal® 205 primer, which is typically used for small-caliber rifles. Embodiments of the primer compound 58 may include various combinations of chemical ingredients. In embodiments, the primer compound 58 includes aluminum and bismuth oxide. In other embodiments, the primer compound 58 includes about 10% aluminum, 60% bismuth oxide, 20% nitrocellulose, and 10% other sensitizers, fuels and binders.

In other embodiments, the primer 36 may be substantially similar to conventional small pistol primers used in conventional handguns, e.g., a 9 mm Luger, with a base thickness 60 of about 0.0170, or generally less than less than 0.020 in. or about 0.0170-0.0200 in. In certain embodiments, pistol primers include a primer compound 58 comprising lead styphnate and barium nitrate. In other embodiments, the primer compound 58 of a pistol primer includes about 40% lead styphnate, about 40% barium nitrate, about 16% PETN, aluminum, antimony sulfide, and about 4% tetrazene. In some embodiments, the primer 36 is the CCI® 550 primer or the Federal® 200 primer.

In certain embodiments, the bullet 32 comprises a core 70 formed of lead or other suitable material surrounded by a jacket 72 formed of, e.g., copper or a copper alloy. The bullet 32 may provide a hollow tip 74 and may be configured to form petals upon impact, for example by including skives 76 (FIG. 2), lines of weakening, or the like. Variations and additional details of various embodiments of handgun ammunition applicable to the present disclosure, including details pertinent to the cartridge 20, case 28, and bullet 32, are disclosed in U.S. patent application Ser. No. 16/509,394, the entire disclosure of which is incorporated herein by reference and for all purposes.

Figures depicting specific dimensions of the 8 mm cartridge 20, and accompanying chamber and barrel dimensions according to embodiments of the disclosure are shown in FIGS. 5A-5B, 6A-6B, 13, and 14.

Figure 7:
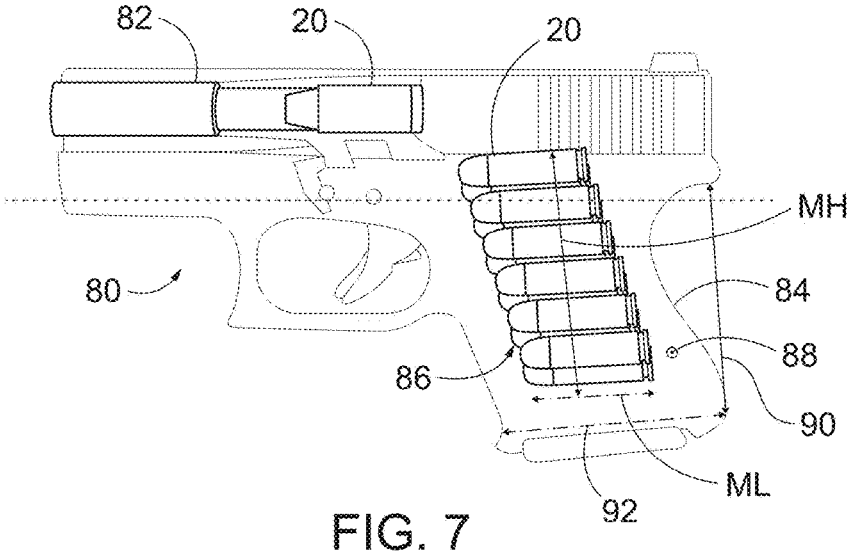
FIG. 7 is a side view of an embodiment of a pistol for use with the 8 mm cartridge of FIG. 2.

A semi-automatic pistol 80 is shown in FIG. 7 comprising a barrel 82 and a grip 84. 8 mm cartridges 20 according to embodiments of this disclosure are double stacked in a magazine 86 within the grip 84. It will be appreciated that when double stacked, the cartridges 20 are a limiting factor in minimizing a thickness 88 of the grip 84, and the cartridges 20 of the present invention have a reduced caliber relative to conventional handgun ammunition that allows for a thinner grip 84. Likewise, the cartridges 20 may allow for reduced grip height 90 while maintaining the same grip length 92 of a 9 mm cartridge arrangement. Accordingly, the pistol 80 is easier and more comfortable for concealed carry use. In alternative embodiments, the grip height 90 may be similar to that of a magazine with 9 mm cartridges, but with 8 mm cartridges will contain at least one additional cartridge.

In certain embodiments, double stacking the 8 mm cartridges 20 in the magazine 86 of the pistol 80 creates an appreciable width advantage over a conventional magazine loaded with a double stack of, for example, 9 mm Luger cartridges. As detailed in FIGS. 7-9, with the same number of 8 mm cartridges 20 double stacked (i.e., ten cartridges in FIG. 8), the magazine width MW is decreased by 0.09 in. and magazine height MH is decreased by 0.26 in. allowing a reduction in size of magazines and grips. As noted above, the cartridge length in some embodiments is the same 1.169 in. for both the 8 mm cartridge 20 and a standard 9 mm cartridge. In certain embodiments, eleven (11) rounds of 8 mm cartridges can fit inside the same height and length of a ten (10) round 9 mm magazine, but with a reduced width. Similarly for single stacked magazines as FIG. 10, the 8 mm cartridges also create an advantage of having eight (8) rounds fitting into a typical height of a seven (7) round 9 mm Luger magazine, while having reduced width.

Figure 8:
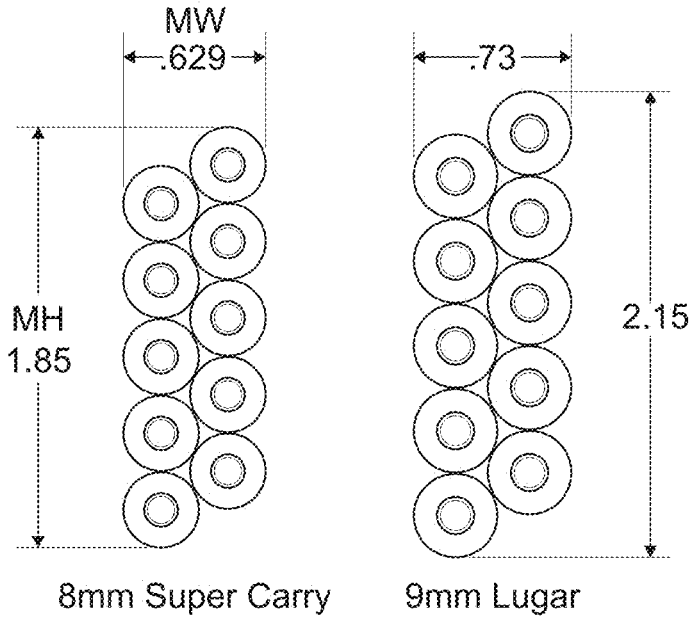
FIG. 8 is a rear elevation view of an arrangement of ten 8 mm cartridges in a magazine in accord with embodiments of the present disclosure and an arrangement of prior art cartridges in a magazine.
Figure 9:
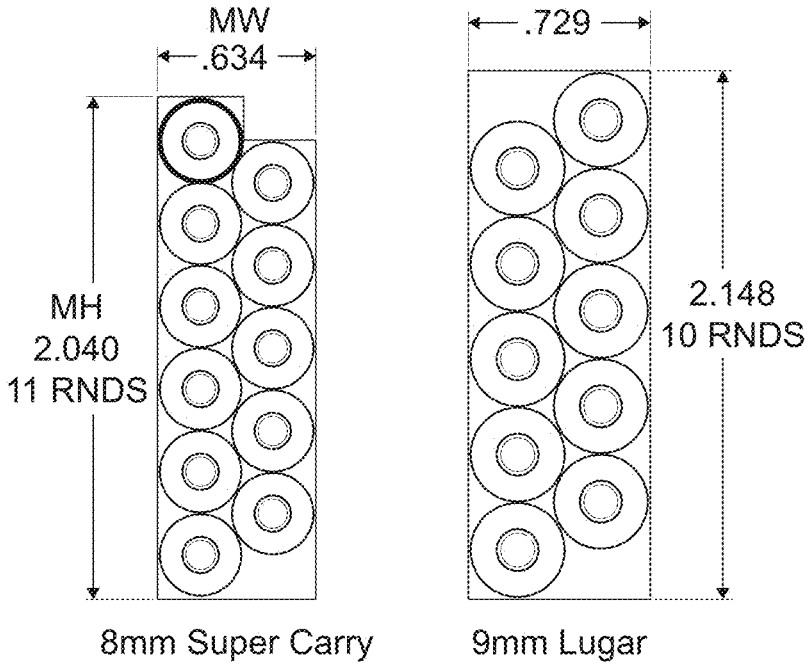
FIG. 9 is rear elevation views of arrangements of 8 mm cartridges in a magazine in accord with embodiments of the present disclosure and an arrangement of prior art cartridges in a magazine.
Figure 10:
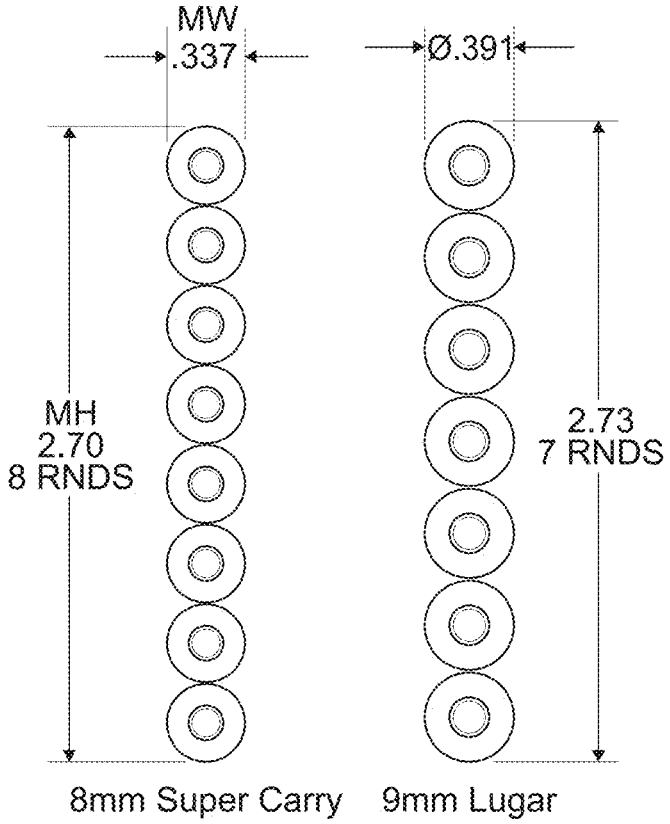
FIG. 10 is a rear elevation view of an arrangement of 8 mm cartridges in a magazine in accord with embodiments of the present disclosure and an arrangement of prior art cartridges in a magazine.

In a general sense, the present invention is directed to a magazine arrangement or a handgun assembly comprising a magazine that reflect the advantages shown in FIGS. 7-10 and described in Tables 1-3 below. For example, FIG. 8 shows an embodiment of a magazine arrangement for ten 8 mm cartridges 20 with an internal magazine height MH of 1.89 in., or less than 2.0 in., and an internal magazine width MW of 0.64 in., or less than 0.7 in. Similarly, FIG. 9 shows another embodiment of a magazine arrangement for eleven 8 mm cartridges 20 double stacked in a size (MH and MW) equal to or less than a standard magazine for ten 9 mm rounds. Various other magazine sizes, capacities, and designs are applicable to the cartridges 20 of the present disclosure.

The ballistics of 8 mm cartridges according to embodiments of the present disclosure are compared to 380 Auto and 9 mm Luger ammunition in Table 1 below. Despite the relatively reduced diameter, 8 mm cartridges have performance in ballistic testing comparable to the conventional 9 mm Luger and 380 Auto due to significantly greater max chamber pressure. Because the muzzle velocity and energy of the 8 mm Super Carry are close to those of the conventional rounds, the feel and recoil closely approximate what a user expects in this class of small ammunition.

TABLE 1

Ballistics Metrics Comparison.

| | 380 Auto | | 8 mm Super Carry | | 9 mm Luger | |
|---|---|---|---|---|---|---|
| Bullet Weight (gr) | 90 | 99 | 100 | 115 | 103 | 115 |
| Muzzle Velocity (fps) | 1000 | 1030 | 1350 | 1160 | 1340 | 1180 |
| Muzzle Energy (ft-lbf) | 200 | 233 | 405 | 344 | 411 | 356 |
| Max Chamber Pressure (psi) | 21,500 | 21,500 | 50,000 | 50,000 | 38,500 | 38,500 |

Figure 11A:
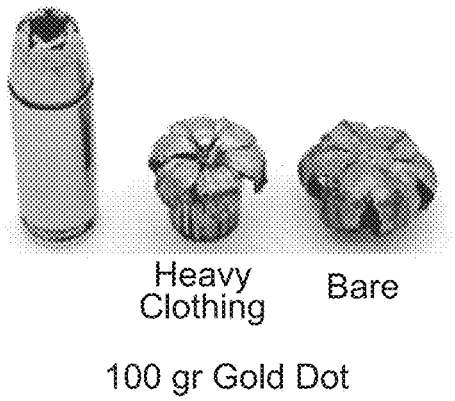
FIG. 11A is front perspective views of ballistics tested 100 grain (gr) cartridges in accord with embodiments of the present disclosure.
Figure 11B:
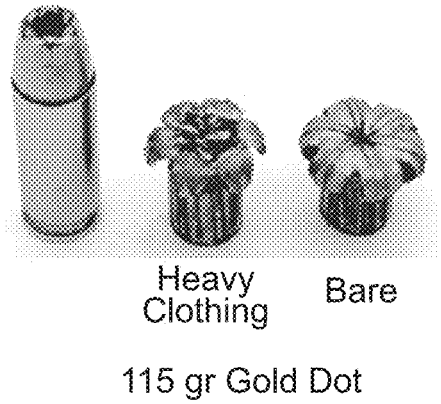
FIG. 11B is front perspective views of ballistics tested 115 gr cartridges in accord with embodiments of the present disclosure.
Figure 12:
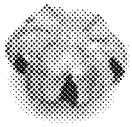
FIG. 12 is front perspective views of upset after ballistics testing for 100 gr and 115 gr cartridges in accord with embodiments of the present disclosure.
Figure 12:
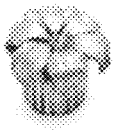
Figure 12:
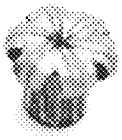
Figure 12:
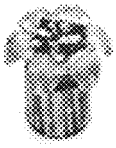
Figure 13:
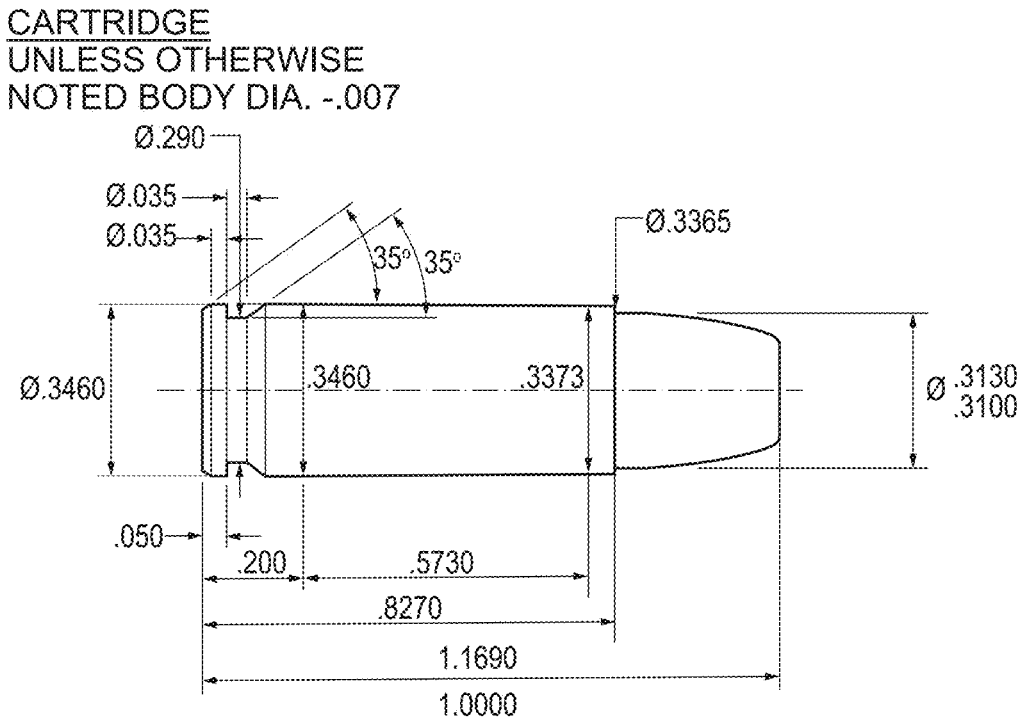
FIG. 13 is a schematic view of another embodiment of an 8 mm cartridge in accord with embodiments of the present disclosure.
Figure 14:
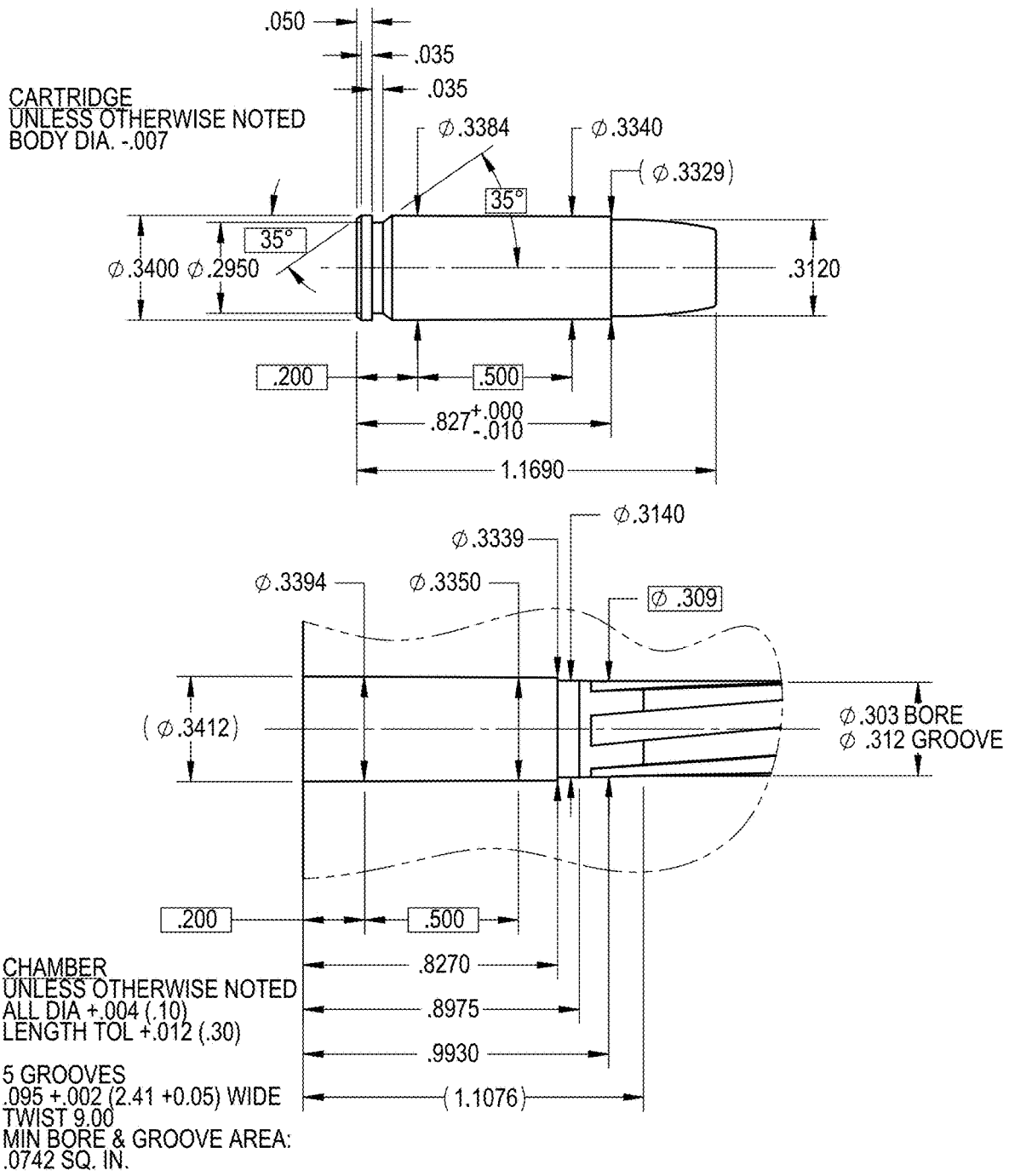
FIG. 14 is a schematic view of still another embodiment of an 8 mm cartridge, and accompanying chamber and barrel dimensions, in accord with embodiments of the present disclosure.

In Tables 2 and 3 below, measured ballistics testing performance is shown for 8 mm cartridges applicable to the present disclosure. Corresponding results of visible upset results for Table 2 are shown in FIGS. 11A and 11B, and visible results for Table 3 are shown in FIG. 12. These tables illustrate the satisfactory results of the 8 mm cartridge in use despite its smaller size than e.g. the 9 mm. For these tests, the bullets were lead with total metal jacket (TMJ), the 100 gr bullet having a length of 0.562 in. and the 115 gr having a length of 0.637 in. Embodiments of the cartridge 20 may be fully or partially jacketed.

TABLE 2

Terminal Ballistics Testing Performance corresponding to FIGS. 11A and 11B.

| | Heavy Clothing | | Bare | |
|---|---|---|---|---|
| | Penetration (in.) | Expanded Diameter (in.) | Penetration (in.) | Expanded Diameter (in.) |
| 100 gr Gold Dot 8 mm | 14 | 0.515 | 12 | 0.570 |
| 115 gr Gold Dot 8 mm | 15 | 0.485 | 13 | 0.520 |

TABLE 3

Terminal Ballistics Testing Performance corresponding to FIG. 12.

| | 10% Bare Gelatin | | 4-Layer Denim | |
|---|---|---|---|---|
| | Penetration (in.) | Diameter (in.) | Penetration (in.) | Diameter (in.) |
| 100 gr Gold Dot 8 mm | 12 | 0.57 | 14 | 0.52 |
| 115 gr Gold Dot 8 mm | 13 | 0.52 | 15 | 0.49 |

It will be appreciated that various embodiments of the cartridge 20 may include features of the bullet 32 and the primer 36 beyond the specific embodiments tested and described herein. The bullet length may vary in other embodiments with hollow point tips or lead free construction, with lengths up to about 0.7 in., about 0.8 in., or about 0.9 in. or shorter lengths of about 0.5 in. or 0.4 in., and sub-ranges therebetween, with a general range of applicable bullet lengths being about 0.4-0.9 in. In embodiments, the bullet 32 may have any weight from about 60 gr-120 gr, including embodiments of about 60 gr, about 70 gr, about 80 gr, about 90 gr, about 100 gr, about 110 gr, about 115 gr, about 120 gr, and sub-ranges therebetween. In embodiments of the primer 36 and the bullet 32, the resulting muzzle energy may range from about 320-405 ft-lbf, or at least 320 ft-lbf. Similarly, in embodiments of the primer 36 and the bullet 32, the resulting muzzle velocity may range from about 1120-1350 fps, or at least 1120 fps.

In general, cartridges applicable to the present disclosure may be used in a variety of firearms with or without a magazine. Although comparison with a 9 mm Luger cartridge is detailed herein, cartridges applicable to the present invention are considered to provide similar benefits and performance relative to the entire class of smaller semiautomatic cartridges.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be omitted or replaced by alternative features serving the same, equivalent or similar purpose, unless expressly stated otherwise. Certain features may sometimes be used to advantage without a corresponding use of other features. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This disclosure is intended to cover adaptations or variations of the present subject matter. Applicants intend to embrace all such alternatives, modifications, equivalents, and variations that are within the spirit and scope of the exemplary embodiments. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A semiautomatic .32 caliber cartridge, comprising:

a rimless case comprising:

a case length of about 0.827 in., a flange diameter of 0.3440 in., an outer case diameter that tapers from a flange diameter of 0.3440 in. to a case mouth diameter of 0.3370 in., an intermediate case portion comprising a length of 0.500 in., a rear end outer diameter of 0.3425 in., and a forward end outer diameter of 0.3381 in., and a rear end comprising a groove and flange, a .32 caliber bullet seated in a case mouth at the forward end of the case and positioned forward of the internal thickness taper portion, the bullet comprising a weight of about 60-120 gr;

a propellant in the case configured to provide a chamber pressure of about 32,000-55,000 psi; and a primer seated in the flange, the cartridge having a length of from 1.100 in. to 1.169 in.

2. The cartridge of claim 1, wherein the muzzle velocity of the bullet fired from a pistol is about 1120-1350 fps.

3. The cartridge of claim 1, wherein the muzzle energy of the bullet fired from a pistol is about 320-405 ft-lbf.

4. The cartridge of claim 1, the case further comprising an internal thickness taper portion that decreases in thickness toward the forward end of the cartridge, the internal thickness taper portion extending for an axial length of about 0.150-0.350 in.

5. The cartridge of claim 1, the primer further comprising dimensions selected from one of:

a base thickness of at least 0.0205 in., a diameter of from 0.1745 in. to 0.1765 in., and a height of from 0.115 in. to 0.126 in., or a base thickness 60 of about 0.0190-0.0200 in., an outer diameter of about 0.1746-0.1752 in., and a height of about 0.1075-0.1165 in.

6. The cartridge of claim 1, the bullet comprising a hollow point.

7. The cartridge of claim 1, the case comprising a brass material.

8. The cartridge of claim 1, the bullet comprising one or more of: a core comprising lead, a jacket comprising copper, and a length of about 0.4-0.9 in.

9. A semiautomatic .32 caliber cartridge, comprising:

a rimless case comprising:

a case length of about 0.827 in., a flange diameter of 0.3440 in., an outer case diameter that tapers from a flange diameter of 0.3450 in. to a case mouth diameter of 0.3370 in., an intermediate case portion comprising a length of 0.500 in., a rear end outer diameter of 0.3425 in., and a forward end outer diameter of 0.3381 in., and a rear end comprising a groove and flange;

a .32 caliber bullet seated in a case mouth at the forward end of the case and positioned forward of the internal thickness taper portion, the bullet comprising a weight of from about 60-120 gr;

a propellant in the case configured to provide a chamber pressure of about from 32,000 psi to 55,000 psi; and a primer seated in the flange, the cartridge having a length of from 1.100 in. to 1.169 in.

10. The cartridge of claim 9, wherein the cartridge generates a pressure comprising 45,000-52,000 psi.

11. The cartridge of claim 9, wherein the muzzle velocity of the bullet fired from a pistol is about 1120-1350 fps.

12. The cartridge of claim 9, wherein the muzzle energy of the bullet fired from a pistol is about 320-405 ft-lbf.

13. The cartridge of claim 9, the case further comprising an internal thickness taper portion that decreases in thickness toward the forward end of the cartridge, the internal thickness taper portion extending for an axial length of about 0.150-0.350 in.

14. The cartridge of claim 9, the bullet comprising a core comprising lead and a jacket comprising copper.

15. The cartridge of claim 9, the bullet comprising one or more of: a hollow point, and a length of from about 0.4-0.9 in.

16. The cartridge of claim 9, the case comprising a brass material.

17. A semiautomatic .32 caliber cartridge, comprising:

a rimless case comprising:

a case length of about 0.827 in., a flange diameter of 0.3440 in., an outer case diameter that tapers from a flange diameter of 0.3440 in. to a case mouth diameter of 0.3370 in., an intermediate case portion comprising a length of 0.500 in., a rear end outer diameter of 0.3425 in., and a forward end outer diameter of 0.3381 in., an internal thickness taper portion that decreases in thickness toward the forward end of the cartridge, and a rear end comprising a groove and flange;

a .32 caliber bullet seated in a case mouth at the forward end of the case and positioned forward of the internal thickness taper portion, the bullet comprising a weight of about 60-120 gr, and length of from about 0.4 in. to 0.9 in.;

a propellant in the case configured to provide a chamber pressure of about 32,000-55,000 psi; and a primer seated in the flange, the cartridge having a length of from 1.100 in. to 1.169 in., the cartridge configured such that the muzzle velocity of the bullet fired from a pistol is about 1120-1350 fps, and the muzzle energy of the bullet fired from a pistol is about 320-405 ft-lbf.

18. The cartridge of claim 17, the internal thickness taper portion extending for an axial length of about 0.150-0.350 in.

19. The cartridge of claim 17, the primer further comprising dimensions selected from one of:

a base thickness of at least 0.0205 in., a diameter of from 0.1745 in. to 0.1765 in., and a height of from 0.115 in. to 0.126 in., or a base thickness 60 of about 0.0190-0.0200 in., an outer diameter of about 0.1746-0.1752 in., and a height of about 0.1075-0.1165 in.

20. The cartridge of claim 17, the bullet comprising one or more of: a hollow point, a core comprising lead, a jacket comprising copper, and a length of about 0.4-0.9 in.

* * * * *